US009327929B2

(12) United States Patent
Nishioka

(10) Patent No.: US 9,327,929 B2
(45) Date of Patent: May 3, 2016

(54) SHEET CONVEYING APPARATUS, AND IMAGE FORMING APPARATUS PROVIDED WITH THE SAME

(71) Applicant: KYOCERA Document Solutions Inc., Osaka-shi, Osaka (JP)

(72) Inventor: Nobuhiro Nishioka, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/216,845

(22) Filed: Mar. 17, 2014

(65) Prior Publication Data

US 2014/0284871 A1 Sep. 25, 2014

(30) Foreign Application Priority Data

Mar. 19, 2013 (JP) ..... 2013-056366

(51) Int. Cl.

| | |
|---|---|
| ***B65H 3/52*** | (2006.01) |
| ***B65H 7/06*** | (2006.01) |
| ***B65H 5/06*** | (2006.01) |
| ***B65H 7/20*** | (2006.01) |
| ***B65H 1/14*** | (2006.01) |
| ***B65H 3/06*** | (2006.01) |
| ***B65H 3/54*** | (2006.01) |
| *B65H 1/10* | (2006.01) |
| *B65H 3/50* | (2006.01) |
| *B65H 3/56* | (2006.01) |

(52) U.S. Cl.

CPC .. *B65H 7/06* (2013.01); *B65H 1/14* (2013.01); *B65H 3/06* (2013.01); *B65H 3/5261* (2013.01); *B65H 3/54* (2013.01); *B65H 5/062* (2013.01); *B65H 7/20* (2013.01); *B65H 1/10* (2013.01); *B65H 3/50* (2013.01); *B65H 3/56* (2013.01); *B65H 2404/1442* (2013.01); *B65H 2405/15* (2013.01); *B65H 2405/312* (2013.01); *B65H 2405/313* (2013.01); *B65H 2405/3311* (2013.01); *B65H 2511/20* (2013.01); *B65H 2513/511* (2013.01); *B65H 2553/82* (2013.01); *B65H 2555/13* (2013.01); *B65H 2701/1311* (2013.01); *B65H 2701/1313* (2013.01); *B65H 2801/06* (2013.01)

(58) Field of Classification Search

USPC ..... 271/123, 273

See application file for complete search history.

(56) References Cited

U.S. PATENT DOCUMENTS

| | | | | |
|---|---|---|---|---|
| 6,349,932 | B1 * | 2/2002 | Suzuki | 271/120 |
| 7,922,169 | B2 * | 4/2011 | Mandel | 271/121 |

FOREIGN PATENT DOCUMENTS

| | | | |
|---|---|---|---|
| JP | 11301875 | A | 11/1999 |
| JP | 2008169024 | A | 7/2008 |

*Primary Examiner* — Howard Sanders

(74) *Attorney, Agent, or Firm* — Alleman Hall McCoy Russell & Tuttle LLP

(57) ABSTRACT

A sheet conveying apparatus according to one aspect of the present disclosure includes a roller drive portion, a first drive portion, a restriction member, a second drive portion, and a drive control portion. Restriction member contacts with rear end of sheet surface, in conveying direction, of uppermost sheet in sheet stack stored in sheet storage portion to restrict feeding of sheet from sheet storage portion. Drive control portion controls roller drive portion, first drive portion, and second drive portion, and causes opposing member to separate from sheet feed roller, and causes restriction member to contact with sheet surface of second sheet to be conveyed immediately after first sheet, after first sheet located on uppermost position of sheet stack is fed by pickup roller and leading end of first sheet in conveying direction passes through sheet feed nip portion.

11 Claims, 8 Drawing Sheets

SHEET CONVEYING APPARATUS, AND IMAGE FORMING APPARATUS PROVIDED WITH THE SAME

INCORPORATION BY REFERENCE

This application is based upon and claims the benefit of priority from the corresponding Japanese Patent Application No. 2013-056366 filed on Mar. 19, 2013, the entire contents of which are incorporated herein by reference.

BACKGROUND

The present disclosure relates to a sheet conveying apparatus that conveys a sheet, and an image forming apparatus provided with the same.

A sheet conveying apparatus that conveys a sheet from a tray storing plural sheets is appropriately used in an image forming apparatus such as a copying machine, a printer, a facsimile, or a multifunction peripheral having functions of these machines. In an image forming apparatus, a sheet conveying apparatus extracts and conveys sheets, one by one, from a sheet storage portion of a tray, and an image is formed on the conveyed sheet in an apparatus body of the image forming apparatus.

The sheet conveying apparatus described above includes a pickup roller, a sheet feed roller, and a retard roller. The pickup roller contacts with an uppermost sheet of the sheets stacked in the sheet storage portion and feeds the sheet in a sheet conveying direction. The sheet feed roller and the retard roller form a sheet feed nip portion in a region downstream of the pickup roller in the sheet conveying direction. A sheet is conveyed, one by one, in the sheet conveying direction at the sheet feed nip portion.

Conventionally, a sheet pressing member that contacts with a rear end of a sheet surface, in the sheet conveying direction, of a sheet stacked in a sheet storage portion for preventing plural sheets from entering the sheet feed nip portion has been known. The sheet pressing member presses the sheets other than the uppermost sheet to restrict entry of the sheets into the sheet feed nip portion.

SUMMARY

A sheet conveying apparatus according to one aspect of the present disclosure includes a housing, a sheet storage portion, a sheet conveying path, a pickup roller, a sheet feed roller, an opposing member, a roller drive portion, a first drive portion, a restriction member, a second drive portion, and a drive control portion. The sheet storage portion is arranged in the housing, and is configured to store a sheet stack of sheets. The sheet conveying path extends from the sheet storage portion, and the sheets are conveyed in the sheet conveying path. The pickup roller is configured to contact with a sheet surface of an uppermost sheet in the sheet stack stored in the sheet storage portion, and feed the sheet in a conveying direction for the sheets. The sheet feed roller is arranged downstream of the pickup roller in the conveying direction, and is configured to convey the sheet in the conveying direction by contacting with the sheet. The opposing member is arranged opposing the sheet feed roller, and forms, in conjunction with the sheet feed roller, a sheet feed nip portion through which the sheet passes. The roller drive portion is configured to rotationally drive the pickup roller and the sheet feed roller. The first drive portion is configured to cause the opposing member to contact with or separate from the sheet feed roller. The restriction member is configured to contact with a rear end of a sheet surface, in the conveying direction, of the uppermost sheet in the sheet stack stored in the sheet storage portion and to restrict feeding of the sheet from the sheet storage portion. The second drive portion is configured to cause the restriction member to contact with or separate from the sheet surface. The drive control portion is configured to control the roller drive portion, the first drive portion, and the second drive portion. The drive control portion causes the opposing member to separate from the sheet feed roller, and causes the restriction member to contact with a sheet surface of a second sheet to be conveyed immediately after a first sheet, after the first sheet located on an uppermost position of the sheet stack is fed by the pickup roller and a leading end of the first sheet in the conveying direction passes through the sheet feed nip portion.

An image forming apparatus according to another aspect of the present disclosure includes the sheet conveying apparatus configured to convey a sheet, an image forming portion configured to form an image onto the sheet conveyed by the sheet conveying apparatus, and a drive control portion. The sheet conveying apparatus includes the housing, the sheet storage portion, the sheet conveying path, the pickup roller, the sheet feed roller, the opposing member, the roller drive portion, the first drive portion, the restriction member, and the second drive portion. The drive control portion controls the roller drive portion, the first drive portion, and the second drive portion, and the drive control portion causes the opposing member to separate from the sheet feed roller, and causes the restriction member to contact with a sheet surface of a second sheet to be conveyed immediately after a first sheet, after the first sheet located on an uppermost position of the sheet stack is fed by the pickup roller and a leading end of the first sheet in the conveying direction passes through the sheet feed nip portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
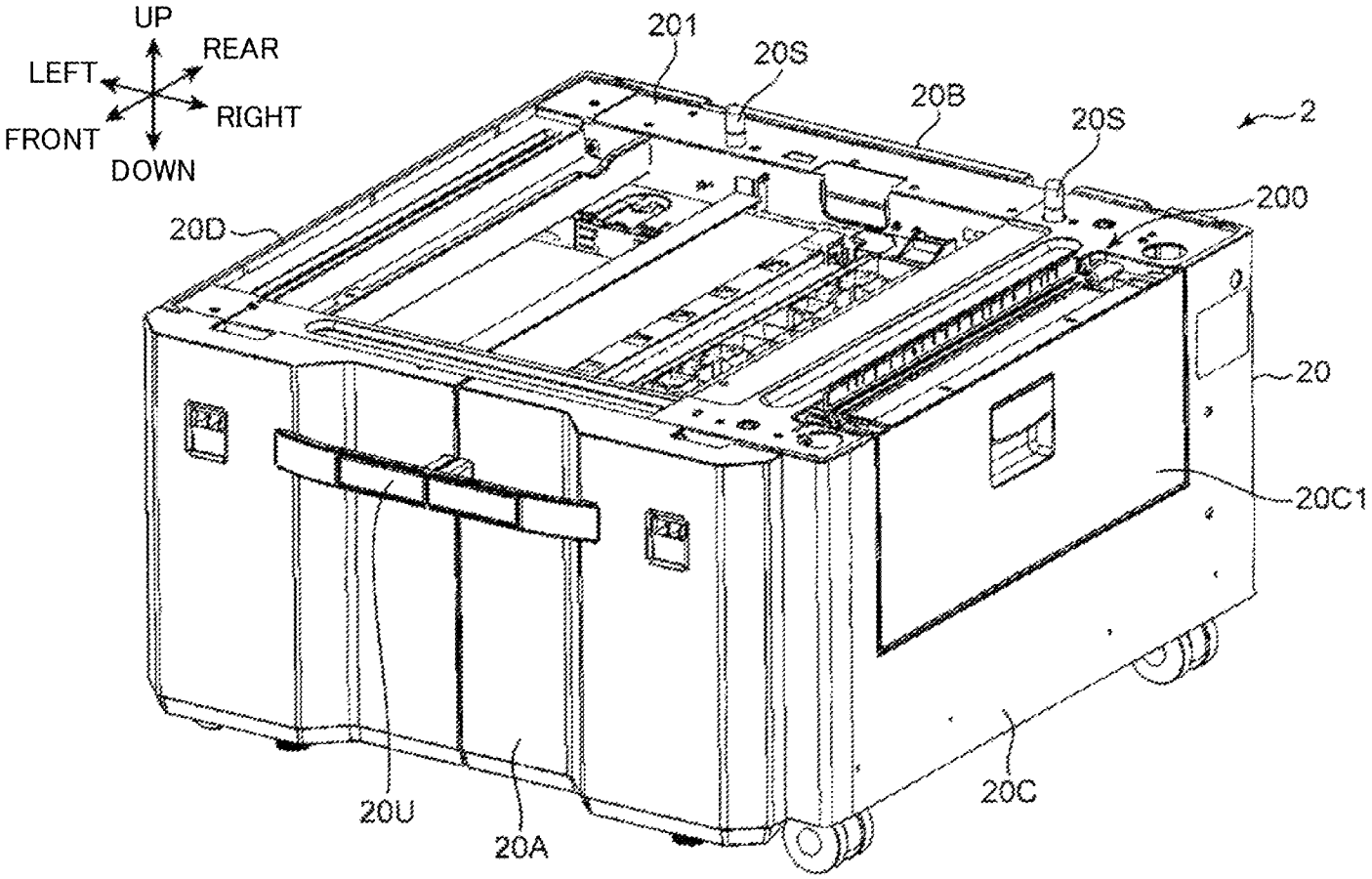
FIG. 1 is a perspective view of a sheet feed deck according to an embodiment of the present disclosure.
Figure 2:
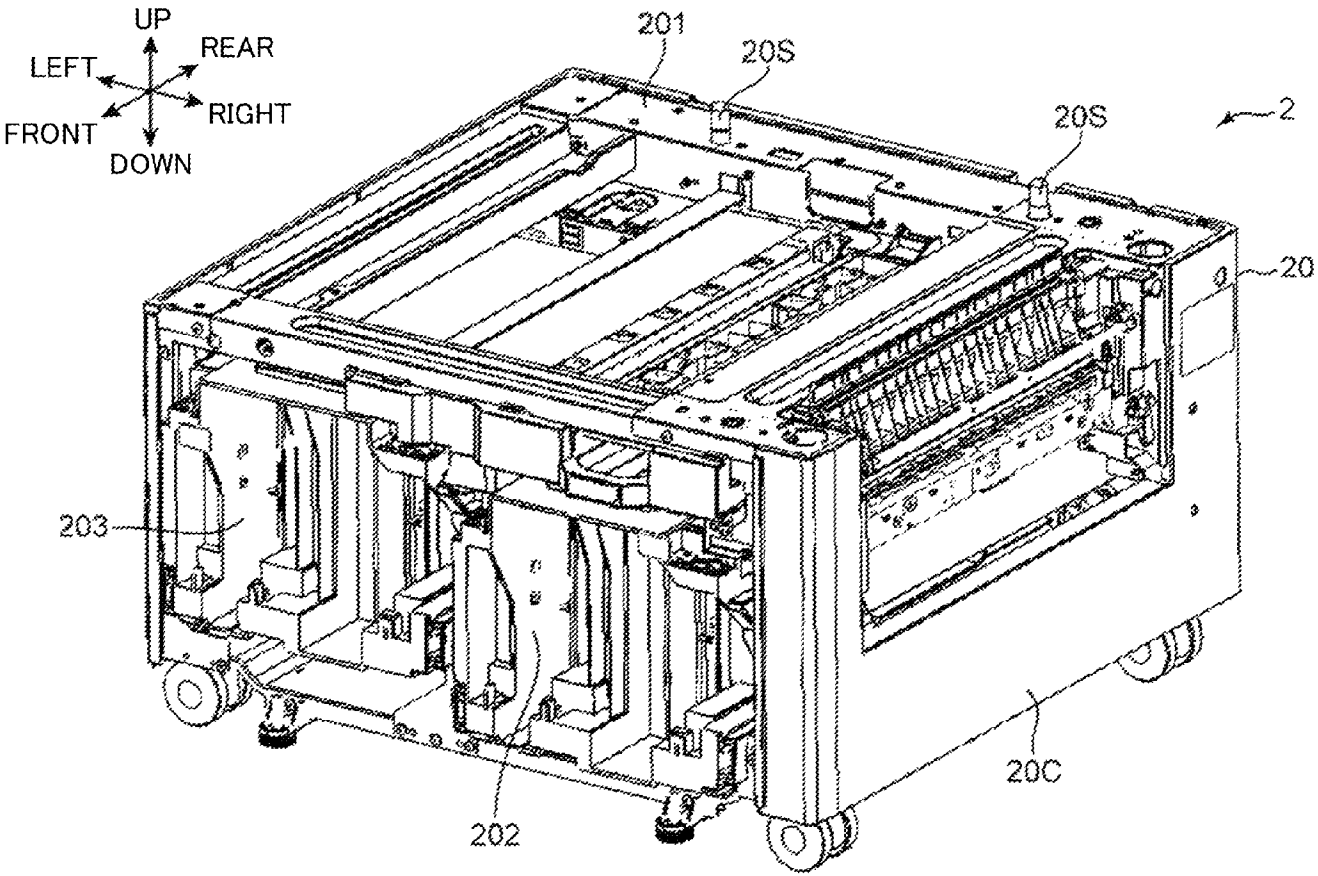
FIG. 2 is a perspective view illustrating an inside of the sheet feed deck according to the embodiment of the present disclosure.
Figure 3:
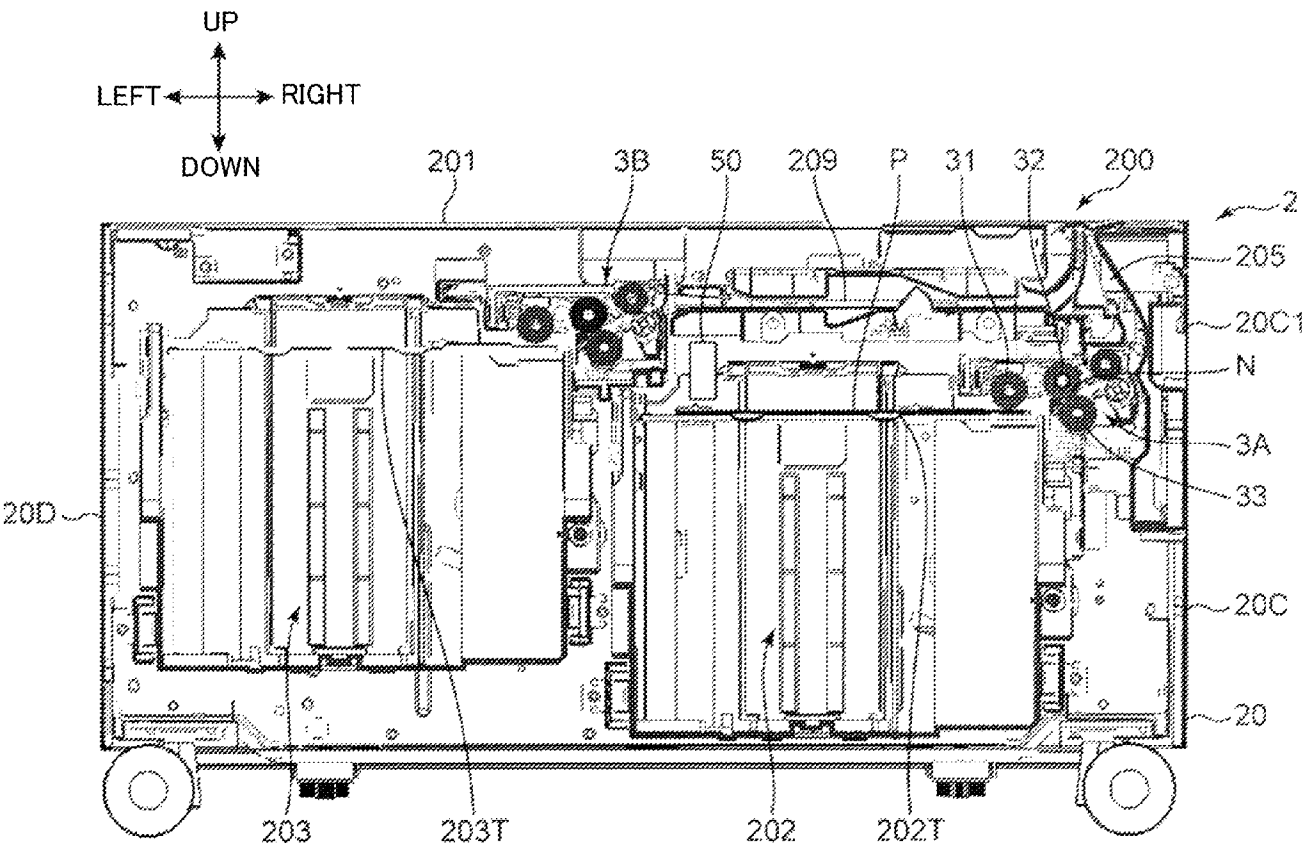
FIG. 3 is a sectional view illustrating the inside of the sheet feed deck according to the embodiment of the present disclosure.
Figure 4:
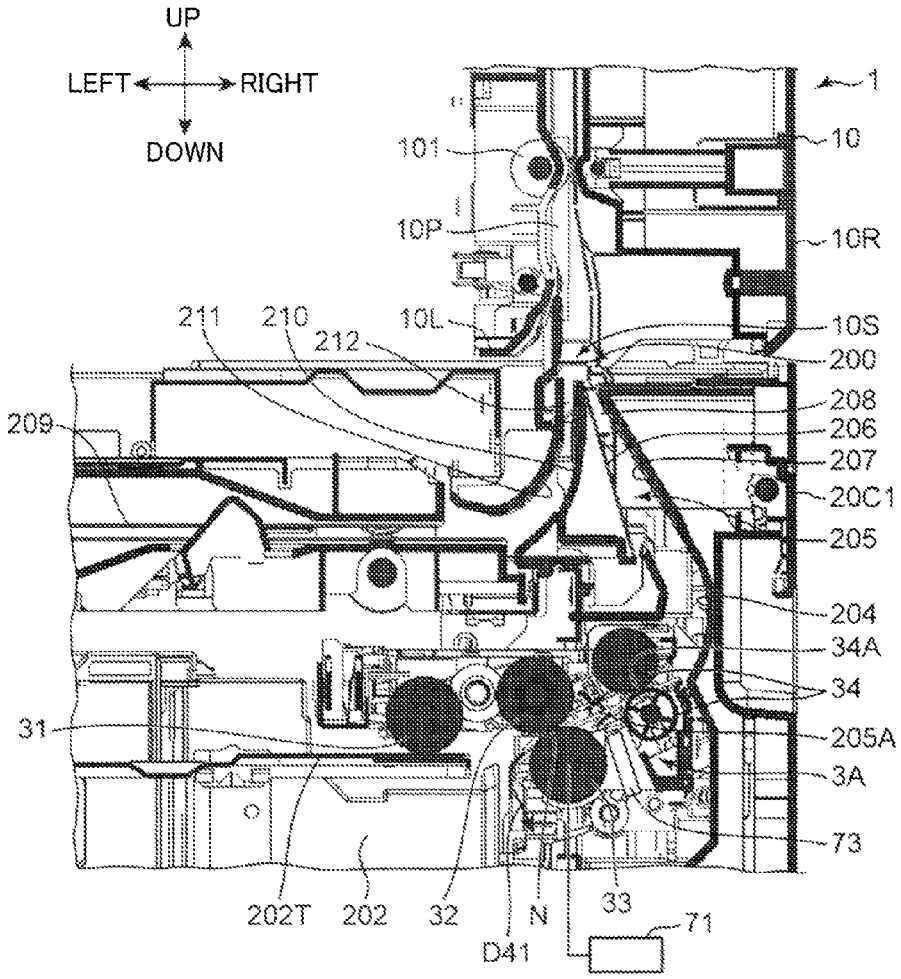
FIG. 4 is an enlarged sectional view illustrating a part of the sheet feed deck and an apparatus body according to the embodiment of the present disclosure.

Hereinafter, an embodiment of the present disclosure will be described in detail with reference to the drawings. FIG. 1 is a perspective view of a sheet feed deck 2 (sheet conveying apparatus) according to one embodiment of the present disclosure. FIG. 2 is a perspective view illustrating a state in which a deck front wall 20A and an opening/closing cover 20C1, which are described below, are removed in FIG. 1. FIG. 3 is a sectional view illustrating an internal structure of the sheet feed deck 2. FIG. 4 is an enlarged sectional view illustrating a part of an image forming apparatus 1 and the sheet feed deck 2.

The sheet feed deck 2 stores plural sheets inside, is mounted to an apparatus body 10 of the image forming apparatus 1, and conveys the sheets to the apparatus body 10.

Figure 8:
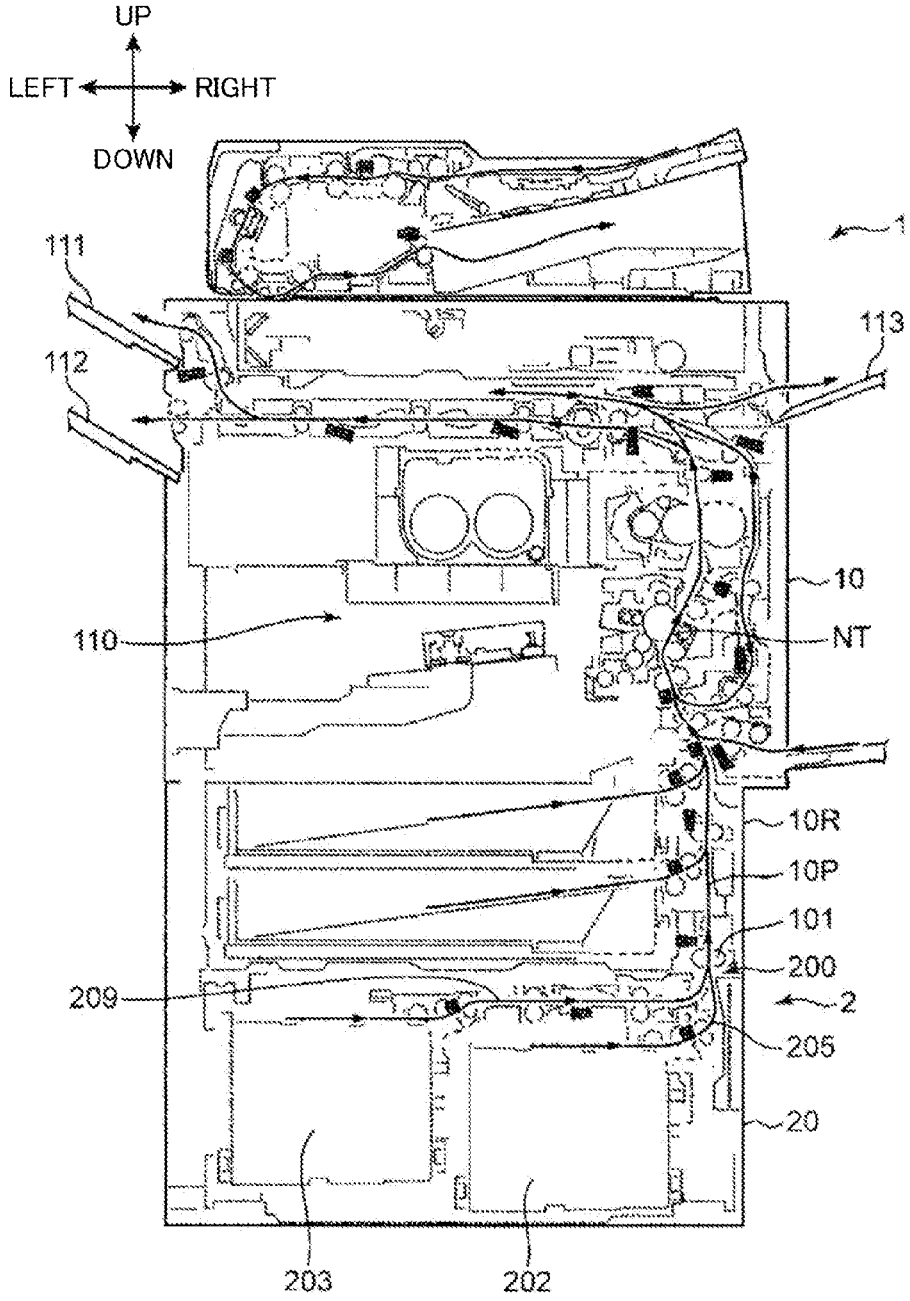
FIG. 8 is a sectional view illustrating a state in which the sheet feed deck is mounted to an image forming apparatus according to the embodiment of the present disclosure.

FIG. 8 is a sectional view illustrating a state in which the sheet feed deck 2 is mounted to the image forming apparatus 1. The image forming apparatus 1 receives a sheet P from the sheet feed deck 2, and forms an image on the sheet P. The image forming apparatus 1 includes an image forming portion 110 that forms an image onto the sheet P. A publicly known image forming technique such as an electrophotographic manner is employed for the image forming portion 110. It is to be noted that other image forming techniques such as an ink jet manner may be employed for the image forming portion 110. The image forming apparatus 1 also includes the apparatus body 10. The apparatus body 10 has a shape of almost a rectangular parallelepiped. As illustrated in FIG. 4, the apparatus body 10 includes a body bottom wall 10L including an insertion portion 10S, and a body-side conveying path 10P which extends upward from the insertion portion 10S and in which the sheet P is conveyed. The insertion portion 10S is an opening portion formed on the body bottom wall 10L. The body-side conveying path 10P is a conveying path extending in the up-down direction near a body right wall 10R of the apparatus body 10. A body conveying roller 101 is arranged on the body-side conveying path 10P. When the sheet feed deck 2 is mounted to the apparatus body 10, the sheet P is conveyed into the body-side conveying path 10P through the insertion portion 10S (see FIG. 4). An image is formed on the sheet P conveyed by the body conveying roller 101, at a transfer nip portion NT (see FIG. 8) of the image forming portion 110, and then, this sheet P is discharged onto any one of sheet discharge portions 111, 112, and 113. Since the image forming apparatus 1 includes the image forming portion 110 and the sheet feed deck 2, the image forming apparatus 1 can continuously form an image onto various types of the sheets P.

Referring to FIG. 1, the sheet feed deck 2 includes a deck body 20 (housing). The deck body 20 has a shape of almost a rectangular parallelepiped. The deck body 20 includes a deck front wall 20A, a deck rear wall 20B, a deck right wall 20C, a deck left wall 20D, a top face portion 201, a sheet feed portion 200, and positioning portions 20S.

The deck front wall 20A is a wall portion defining a front face of the deck body 20. The deck front wall 20A includes a grip portion 20U. When an operator grips the grip portion 20U, the deck front wall 20A, and a first storage portion 202 and a second storage portion 203 which are described below, are drawn forward from the deck body 20. The deck rear wall 20B is a wall portion defining a rear face of the deck body 20. Similarly, the deck right wall 20C and the deck left wall 20D are wall portions defining a right face and a left face of the deck body 20.

The top face portion 201 defines a top face of the deck body 20. When the sheet feed deck 2 is mounted to the apparatus body 10 of the image forming apparatus 1, the top face portion 201 is arranged opposing the body bottom wall 10L of the apparatus body 10.

The sheet feed portion 200 is an opening portion formed at the right side portion on the top face portion 201. The sheet feed portion 200 extends in a slit-like form in a front-rear direction so as to correspond to the widthwise direction of the sheet P, and the sheet P is discharged upward from the sheet feed portion 200.

The positioning portions 20S are a pair of projecting portions arranged, at the rear end portion on the top face portion 201, to have a space therebetween in the right-left direction. The positioning portions 20S are inserted into not-illustrated insertion holes in the apparatus body 10. The position of the deck body 20 and the position of the apparatus body 10 are determined by the positioning portions 20S and the insertion holes.

Referring to FIGS. 2 and 3, the sheet feed deck 2 also includes the first storage portion 202 (sheet storage portion), the second storage portion 203, a first conveying portion 3A, and a second conveying portion 3B. The first storage portion 202 and the second storage portion 203 are arranged adjacent to each other in the right-left direction in the deck body 20. The first storage portion 202 and the second storage portion 203 have almost a box-like shape, and store sheets P inside. In this case, the sheets P are stored in the first storage portion 202 and the second storage portion 203 so as to be oriented along substantially the horizontal direction, and plural sheets P are stacked as sheet stacks in the up-down direction. In other words, the sheet stack is formed by stacking plural sheets P. The first conveying portion 3A and the second conveying portion 3B are units that feed the sheets P stored in the first storage portion 202 and the second storage portion 203 toward the sheet feed portion 200.

Referring to FIG. 4, the first conveying portion 3A includes a pickup roller 31, a sheet feed roller 32, a retard roller 33 (an opposing member), and a pair of conveying rollers 34. The sheet P is convened in almost an upper-right direction (referred to as a sheet conveying direction, or merely referred to as a conveying direction in some cases) by the first conveying portion 3A. A lifting plate 202T is arranged on the above first storage portion 202.

The pickup roller 31 contacts with the sheet surface of the sheet P stored in the first storage portion 202, and feeds (sends) the sheet P downstream in the sheet conveying direction. The sheet feed roller 32 is arranged downstream from the pickup roller 31 in the sheet conveying direction, and feeds the sheet on the uppermost position (highest position) of the plural sheets P fed by the pickup roller 31, to convey the sheets P one by one in the sheet conveying direction. The sheet feed roller 32 includes a circumferential surface that contacts with the sheet P.

The retard roller 33 is arranged opposing the circumferential surface of the sheet feed roller 32. The retard roller 33 forms a sheet feed nip portion N with the circumferential surface of the sheet feed roller 32. The outer circumferential portion of the retard roller 33 that contacts with the circumferential surface of the sheet feed roller 32 is made of an elastic material. In the present embodiment, the outer circumferential portion of the retard roller 33 is made of a rubber material. The retard roller 33 prevents the sheets other than the sheet on the uppermost position (highest position) from being conveyed downstream in the conveying direction from the sheet feed nip portion N. The retard roller 33 is rotated so as to follow the sheet feed roller 32 and the sheet, when the sheet P passes one by one through the sheet feed nip portion N, in other words, when the sheet P is not multi-fed.

The pair of the conveying rollers 34 is a pair of conveying rollers arranged downstream from the sheet feed roller 32 (the sheet feed nip portion N) in the sheet conveying direction, so as to oppose the first sheet conveying path 205. The pair of the conveying rollers 34 forms a conveying nip portion 34A for conveying the sheet P, which is conveyed by the sheet feed roller 32, toward the sheet feed portion 200 located in a further downstream region in the conveying direction.

The lifting plate 202T is a plate member arranged horizontally in the first storage portion 202. The sheet P is stacked onto the lifting plate 202T. The lifting plate 202T is movable in the up-down direction by a not-illustrated drive portion. By the elevating motion of the lifting plate 202T, the sheet surface of the sheet P stored in the first storage portion 202 is brought into contact with the pickup roller 31.

As illustrated in FIG. 3, the second conveying portion 3B that feeds the sheets stored in the second storage portion 203 has the structure similar to that of the first conveying portion 3A. The second storage portion 203 similarly includes a lifting plate 203T.

Referring to FIG. 4, the sheet feed deck 2 also includes a first wall portion 204, the first sheet conveying path 205 (sheet conveying path), a second wall portion 206, a third wall portion 207, and a first outlet portion 208. The sheet feed deck 2 also includes a second sheet conveying path 209, a fourth wall portion 210, a fifth wall portion 211, and a second outlet portion 212.

The first wall portion 204 is a wall portion extending in the up-down direction to the right of the pair of the conveying rollers 34. The sheet P conveyed by the pair of the conveying rollers 34 is guided upward by the first wall portion 204. The first sheet conveying path 205 is a conveying path which extends from the first storage portion 202 to the top face portion 201, and in which the sheet P is conveyed in a predetermined conveying direction. The first sheet conveying path 205 can communicate with the body-side conveying path 10P of the apparatus body 10. The first sheet conveying path 205 extends rightward from the first storage portion 202, and then extends upward. The second wall portion 206 is a wall portion defining a region, on the top face portion side, of the first sheet conveying path 205. The second wall portion 206 defines a left side portion of the first sheet conveying path 205. The second wall portion 206 extends almost in the up-down direction. The third wall portion 207 is a wall portion defining a region, on the top face portion 201 side, of the first sheet conveying path 205. The third wall portion 207 is connected with an upper end portion of the first wall portion 204. The third wall portion 207 defines a right side portion of the first sheet conveying path 205, and guides the sheet P in the upper-left direction. The first wall portion 204 and the third wall portion 207 correspond to a left wall portion of the opening/closing cover 20C1 described below. The first outlet portion 208 is arranged on the first sheet conveying path 205 in the vicinity of the top face portion 201. The sheet P is discharged to the outside of the deck body 20 from the first outlet portion 208. The first outlet portion 208 corresponds to a part of the above sheet feed portion 200.

The second sheet conveying path 209 is a conveying path extending from the second storage portion 203 to the top face portion 201. The second sheet conveying path 209 can communicate with the body-side conveying path 10P on the apparatus body 10. The second sheet conveying path 209 extends rightward from the second storage portion 203, and then extends upward. The fourth wall portion 210 is a wall portion defining an upward extending region of the second sheet conveying path 209, i.e., a region on the top face portion 201 side of the second sheet conveying path 209. The fourth wall portion 210 defines a right side of the second sheet conveying path 209. The above-described second wall portion 206 and the fourth wall portion 210 are wall portions made of the same member, and correspond respectively to a right side face and a left side face of the wall portions. The fifth wall portion 211 is arranged on the deck body 20, and is a wall portion defining a region on the top face portion 201 side of the second sheet conveying path 209. The fifth wall portion 211 defines a left side of the second outlet portion 212 of the second sheet conveying path 209. The second outlet portion 212 is arranged on the second sheet conveying path 209 in the vicinity of the top face portion 201. The sheet P is discharged to the outside of the deck body 20 from the second outlet portion 212. The second outlet portion 212 is arranged adjacent to the first outlet portion 208, and corresponds to a part of the above sheet feed portion 200.

As described above, in the present embodiment, the first sheet conveying path 205 and the second sheet conveying path 209 are adjacent to each other and exposed to the outside on the top face portion 201. The sheet feed portion 200 described above is composed of the first outlet portion 208 and the second outlet portion 212. The sheet P is conveyed from the sheet feed portion 200 toward the outside of the deck body 20. Accordingly, the sheets P stored in two sheet storage portions (the first storage portion 202 and the second storage portion 203) are conveyed into the apparatus body 10 through the common sheet feed portion 200.

The deck body 20 also includes the opening/closing cover 20C1 (see FIGS. 1, 3, and 4). The opening/closing cover 20C1 is pivotable about the lower end portion so as to be openable and closable relative to the deck right wall 20C of the deck body 20. Specifically, the opening/closing cover 20C1 can be switched between an opened state in which the opening/closing cover 20C1 is opened relative to the deck body 20 to expose the first sheet conveying path 205 to the outside and a closed state in which the opening/closing cover 20C1 defines a part of the first sheet conveying path 205. As illustrated in FIG. 4, in particular, the first sheet conveying path 205 is exposed on the right side of the deck body 20 by opening the opening/closing cover 20C1 rightward, even if the apparatus body 10 and the deck body 20 are coupled to each other in the up-down direction. Accordingly, even if the sheet P is jammed in the first sheet conveying path 205, the jammed sheet is appropriately removed.

The sheet feed deck 2 also includes a restriction member 50 (see FIG. 3). The restriction member 50 is arranged at the upper portion of the first storage portion 202 at the left part of the first storage portion 202. The restriction member 50 contacts with the rear end, in the sheet conveying direction, of the sheet surface (the left part of the sheet surface) of the sheet P stored in the first storage portion 202. Specifically, the restriction member 50 contacts with the sheet surface with biasing force from above the sheets P stored in the first storage portion 202. In the present embodiment, the restriction member 50 contacts with the sheet surface by its own weight, in particular. As a result, the restriction member 50 restricts feeding of the sheet P from the first storage portion 202 in the sheet conveying direction. The feeding of the sheet P is stably restricted by utilizing the weight of the restriction member 50. In the present embodiment, the restriction member 50 is a rubber member having a shape of almost a rectangular parallelepiped (see FIG. 6). The portion of the restriction member 50 that contacts with the sheet surface is made of a rubber material, whereby friction force between the restriction member 50 and the sheet P increases to appropriately restrict the conveyance of the sheet P. According to the contact of the restriction member 50, the generation of damages or wrinkles on the sheet surface is prevented. The restriction member 50 can be moved in the up-down direction by a second solenoid 72 described below.

Figure 5:
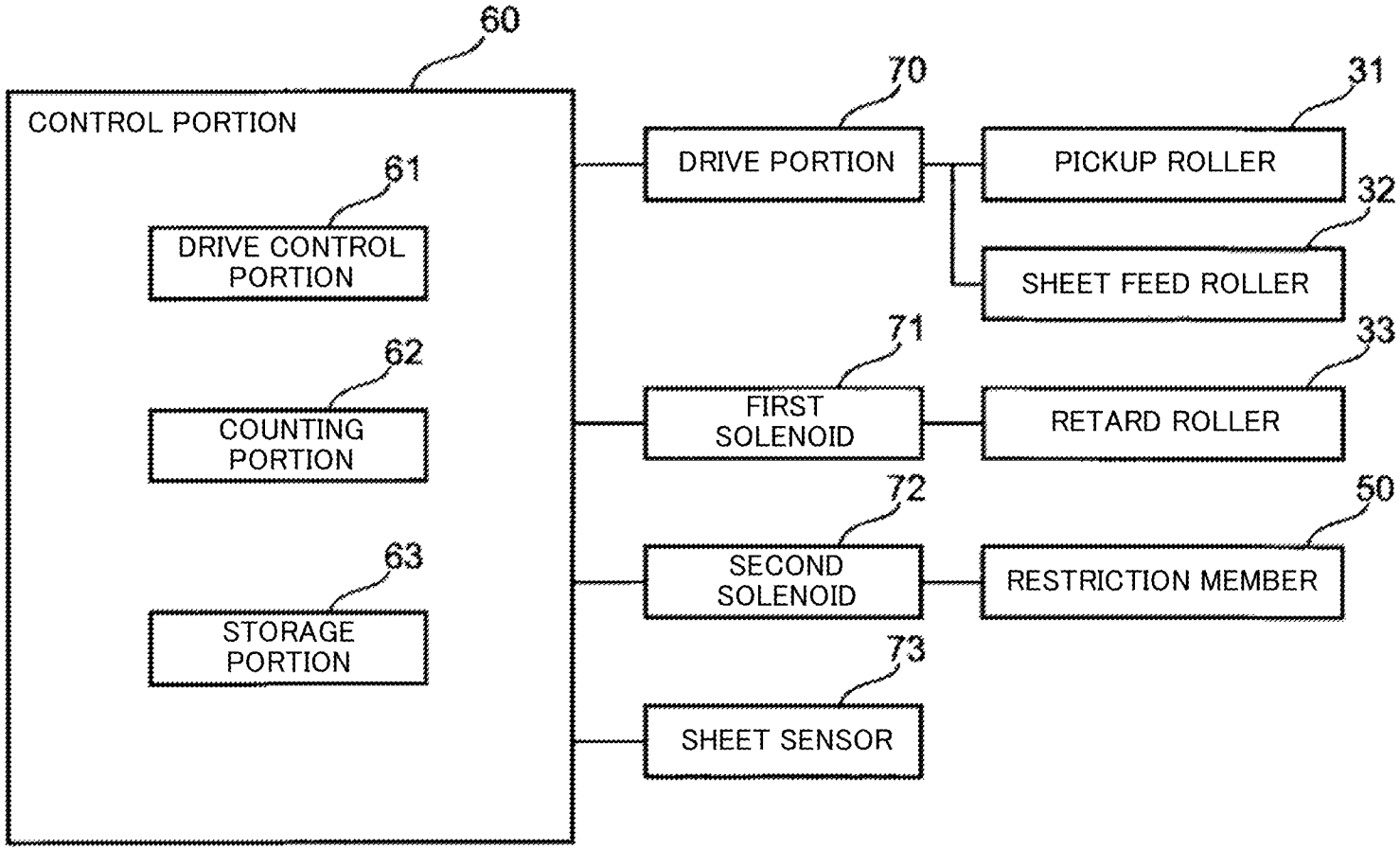
FIG. 5 is an electrical block diagram of a control portion according to the embodiment of the present disclosure.
Figure 6:
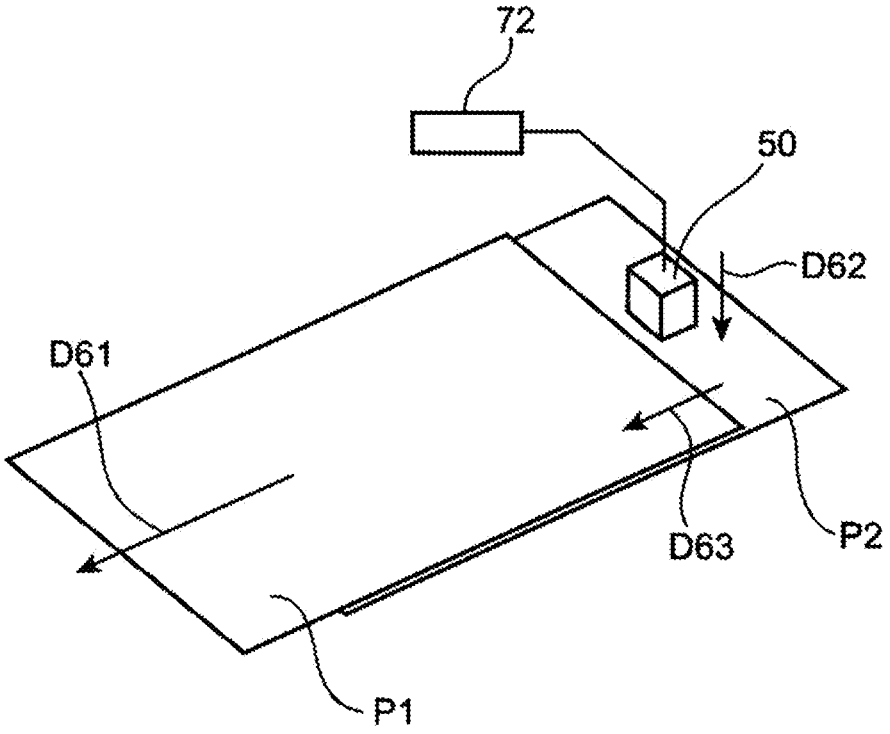
FIG. 6 is a perspective view illustrating a state in which a restriction member according to the embodiment of the present disclosure presses a sheet.
Figure 7:
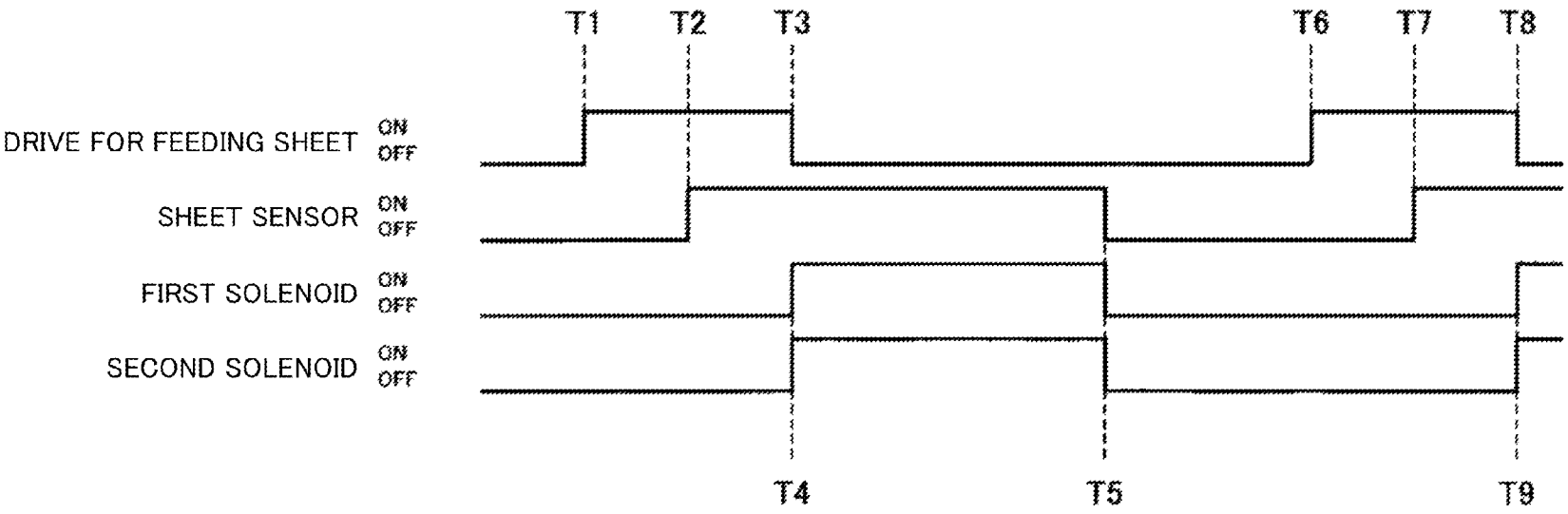
FIG. 7 is a timing chart illustrating an operation of the restriction member and an opposing member according to the embodiment of the present disclosure.

Next, the operation and effect of the above restriction member 50 will be described. FIG. 5 is an electrical block diagram of a control portion 60 in the sheet feed deck 2. The control portion 60 comprehensively controls an operation of the restriction member 50 and an operation of each component arranged in the sheet feed deck 2. FIG. 6 is a perspective view illustrating a state in which the restriction member 50 contacts with the sheet surface of the sheet P stored in the first storage portion 202. FIG. 7 is a timing chart illustrating the relationship between the sheet feeding operation for the sheet P and the restriction operation of the restriction member 50.

Referring to FIG. 5, the sheet feed deck 2 includes a drive portion 70 (roller drive portion), a first solenoid 71 (first drive portion), a second solenoid 72 (second drive portion), and a sheet sensor 73 (sheet detection portion).

The drive portion 70 is controlled by a drive control portion 61 described below such that, by the drive portion 70, the pickup roller 31 and the sheet feed roller 32 are driven to rotate at a predetermined timing in synchronization with each other. With this operation, the sheet P stored in the first storage portion 202 is conveyed downstream in the sheet conveying direction by the pickup roller 31. The sheet P conveyed by the pickup roller 31 is further conveyed downstream in the sheet conveying direction by the sheet feed roller 32. The drive portion 70 includes a motor and a gear, which are not illustrated. The drive portion 70 also rotationally drives the pair of the conveying rollers 34 at a predetermined timing.

The first solenoid 71 (see FIG. 4) causes the retard roller 33 to contact with or separate from the circumferential surface of the sheet feed roller 32. The first solenoid 71 is coupled to a not-illustrated rotation shaft of the retard roller 33. The first solenoid 71 is controlled by the drive control portion 61 described below, to execute a predetermined advancing/retreating operation. The advancing/retreating operation of the first solenoid 71 is transmitted to the rotation shaft of the retard roller 33 through a not-illustrated first drive transmission mechanism. Accordingly, the contact/separation operation by the first solenoid 71 is realized.

The second solenoid 72 (see FIG. 6) causes the restriction member 50 to contact with or separate from the sheet surface of the sheet P stored in the first storage portion 202. In other words, the second solenoid 72 moves the restriction member 50 in the upper portion of the first storage portion 202 in the up-down direction. The second solenoid 72 is controlled by the drive control portion 61 described below to execute a predetermined advancing/retreating operation. The advancing/retreating operation of the second solenoid 72 is transmitted to the restriction member 50 through a not-illustrated second drive transmission mechanism. Accordingly, the contact/separation operation (up-down movement) of the restriction member 50 is realized.

The sheet sensor 73 is arranged between the sheet feed roller 32 and the pair of the conveying rollers 34, and detects the sheet P conveyed in the first sheet conveying path 205. In other words, the sheet sensor 73 is arranged opposing a sensor opposing portion 205A. The sensor opposing portion 205A is arranged in the first sheet conveying path 205 between the sheet feed nip portion N and the conveying nip portion 34A where the pair of the conveying rollers 34 face each other. The sheet sensor 73 transmits a predetermined output signal to the control portion 60 when a leading end or a rear end of the sheet P in the conveying direction passes through the sensor opposing portion 205A.

The control portion 60 includes a CPU (Central Processing Unit), a ROM (Read Only Memory) storing a control program, a RAM (Random Access Memory) used as a work area of the CPU, and the like. The above drive portion 70, the first solenoid 71, the second solenoid 72, and the sheet sensor 73 are electrically connected to the control portion 60. The control portion 60 functions as the drive control portion 61, a counting portion 62, and a storage portion 63 by the execution of the control program stored in the ROM by the CPU.

The drive control portion 61 controls the driving operation of the drive portion 70, the first solenoid 71, and the second solenoid 72. Particularly, after an uppermost first sheet P1 (see FIG. 6) in the stacked sheets P stored in the first storage portion 202 is fed by the pickup roller 31 and the leading end of the first sheet P1 in the conveying direction passes through the sheet feed nip portion N, the drive control portion 61 causes the retard roller 33 to separate from the circumferential surface of the sheet feed roller 32 and causes the restriction member 50 to contact with a second sheet P2 (see FIG. 6) located below the first sheet P1.

The counting portion 62 calculates various timings used in each control operation by the control portion 60. For example, the counting portion 62 calculates a timing when the leading end of the first sheet P1 arrives at the conveying nip portion 34A based on detection information indicating that the sheet sensor 73 has detected the leading end of the first sheet P1 in the conveying direction. In this case, the above drive control portion 61 causes the retard roller 33 and the restriction member 50 to be in contact state or separated state based on the calculation result by the counting portion 62. Accordingly, the timing when the leading end of the first sheet P1 arrives at the conveying nip portion 34A is predicted, whereby the contact/separation operation of the retard roller 33 and the restriction member 50 can assuredly be performed. The storage portion 63 is a memory portion in the sheet feed deck 2. The storage portion 63 previously stores a time threshold value TP1 and a distance-between-sheets threshold value TQ1, which are described below.

Next, the state in which the sheet P is fed from the first storage portion 202 and the operations of the retard roller 33 and the restriction member 50 in this case will be described with reference to FIG. 7. In FIG. 7, the pickup roller 31 and the sheet feed roller 32 are rotationally driven from times T1 to T3. In this case, the uppermost first sheet P1 in the stacked sheets P stored in the first storage portion 202 is conveyed into the first sheet conveying path 205. Similarly, the pickup roller 31 and the sheet feed roller 32 are also rotationally driven from times T6 to T8. In this case, the second sheet P2 located below the first sheet P1 in the sheets P stored in the first storage portion 202 is conveyed into the first sheet conveying path 205.

The drive control portion 61 controls the drive portion 70 at the time T1, whereby the pickup roller 31 and the sheet feed roller 32 are rotationally driven. Thus, the first sheet P1 is fed to the sheet feed nip portion N (see FIG. 4) between the sheet feed roller 32 and the retard roller 33 (see an arrow D61 in FIG. 6). When the leading end of the first sheet P1 in the conveying direction then passes through the sheet feed nip portion N to arrive at the sensor opposing portion 205A (see FIG. 4), the sheet sensor 73 detects the leading end (see the time T2). The sheet sensor 73 transmits a predetermined output signal to the control portion 60 as the detection information about the leading end of the first sheet P1. On the receipt of the output signal, the counting portion 62 starts counting a movement time ΔTP of the first sheet P1. The counting portion 62 counts the movement time ΔTP till the time threshold value TP1 that is previously stored in the storage portion 63 is reached. The time threshold value TP1 corresponds to a time obtained by dividing, by the conveyance speed of the sheet P, a distance in the first sheet conveying path 205 from the sensor opposing portion 205A to the conveying nip portion 34A between the pair of the conveying rollers 34. Specifically, when the movement time ΔTP counted by the counting portion 62 reaches the time threshold value TP1, the leading end of the first sheet P1 arrives at the conveying nip portion 34A. Accordingly, even if a sheet sensor is not arranged on the conveying nip portion 34A, the arrival of the sheet P at the conveying nip portion 34A is appropriately grasped.

After the leading end of the first sheet P1 arrives at the conveying nip portion 34A between the pair of the conveying rollers 34 (see the time T3), the drive control portion 61 stops the rotation of at least the sheet feed roller 32. Before the time T3, the pair of the conveying rollers 34 is rotationally driven in advance by the drive portion 70. Therefore, the first sheet P1 delivered to the pair of the conveying rollers 34 from the sheet feed roller 32 is stably conveyed downstream in the first sheet conveying path 205 in the conveying direction by the pair of the conveying rollers 34. In addition, the rotation of the sheet feed roller 32 is stopped after the pair of the conveying rollers 34 enters a state where the pair of the conveying rollers 34 can convey the first sheet P1, whereby an excessive rotation of the sheet feed roller 32 can be prevented. Furthermore, the rotation of the sheet feed roller 21 is less likely to prevent conveying of the first sheet P by the pair of the conveying rollers 34.

After the leading end of the first sheet P1 arrives at the conveying nip portion 34A between the pair of the conveying rollers 34 (see the time T3), the drive control portion 61 controls the first solenoid 71 to cause the retard roller 33 to be moved downward and separated from the circumferential surface of the sheet feed roller 32 (see the time T4 and an arrow D41 in FIG. 4), and controls the second solenoid 72 to cause the restriction member 50 to contact with the second sheet P2 (see the time T4 and an arrow D62 in FIG. 6). In other words, the retard roller 33 is separated from the circumferential surface of the sheet feed roller 32 after the pair of the conveying rollers 34 enters a state where the pair of the conveying rollers 34 can convey the first sheet P1. Therefore, the conveyance of the first sheet P1 is stably maintained by the pair of the conveying rollers 34. As illustrated in FIG. 6, the first sheet P1 is sent in the sheet conveying direction (the arrow D61) in this case. Accordingly, the sheet surface of the second sheet P2 is exposed at the rear end of the second sheet P2 in the conveying direction and at the position opposing the restriction member 50, so as to face upward.

When the rear end of the first sheet P1 conveyed by the pair of the conveying rollers 34 in the conveying direction then arrives at the sensor opposing portion 205A, the rear end is detected by the sheet sensor 73 (see the time T5). The sheet sensor 73 transmits a predetermined output signal to the control portion 60 as the detection information about the rear end of the first sheet P1. The counting portion 62 starts counting a distance-between-sheets time ΔTQ on receipt of the output signal. The counting portion 62 counts the distance-between-sheets time ΔTQ till the distance-between-sheets threshold value TQ1 that is previously stored in the storage portion 63 is reached. The distance-between-sheets threshold value TQ1 is a threshold value related to the time that is preset so as to correspond to a distance between a sheet P and an immediately following sheet P when the sheets P are continuously conveyed in the first sheet conveying path 205 and the body-side conveying path 10P of the apparatus body 10.

After the rear end, in the conveying direction, of the first sheet P1 conveyed by the pair of the conveying rollers 34 is detected by the sheet sensor 73 (see the time T5) as described above, the drive control portion 61 controls the first solenoid 71 to cause the retard roller 33 to contact again with the circumferential surface of the sheet feed roller 32, and controls the second solenoid 72 to cause the restriction member 50 to separate from the sheet surface of the second sheet P2. Thus, the sheet feeding operation for the second sheet P2 by the pickup roller 31 is stably started. The contact of the retard roller 33 and the separation of the restriction member 50 are stably realized as a preparation operation for feeding the second sheet P2, based on the detection result of the sheet sensor 73. A distance between the sheets is assuredly formed between the rear end of the first sheet P1 and the leading end of the second sheet P2. The contact and separation of the retard roller 33 and the restriction member 50 may be executed immediately after the detection of the rear end of the sheet P by the sheet sensor 73 (see the time T5) as illustrated in FIG. 7, or the contact and separation of the retard roller 33 and the restriction member 50 may be executed after a lapse of a predetermined time from the detection of the rear end of the sheet P by the sheet sensor 73.

When the distance-between-sheets time ΔTQ counted by the counting portion 62 then reaches the distance-between-sheets threshold value TQ1, the drive control portion 61 controls the drive portion 70 to rotationally drive the pickup roller 31 and the sheet feed roller 32 (see the time T6). Thus, the second sheet P2 is sent to the sheet feed nip portion N (see FIG. 4) between the sheet feed roller 32 and the retard roller 33 (see an arrow D63 in FIG. 6). Similarly, when the leading end of the second sheet P2 in the conveying direction passes through the sheet feed nip portion N to arrive at the sensor opposing portion 205A (see FIG. 4), the sheet sensor 73 detects the leading end (see the time T7). After the leading end of the second sheet P2 arrives at the conveying nip portion 34A between the pair of the conveying rollers 34 (see the time T8), the drive control portion 61 stops the rotation of at least the sheet feed roller 32. In addition, the drive control portion 61 controls the first solenoid 71 to cause the retard roller 33 to be moved downward and separated from the circumferential surface of the sheet feed roller 32, and controls the second solenoid 72 to cause the restriction member 50 to contact with a not-illustrated third sheet located below the second sheet P2 (see the time T9). Consequently, the sheet P is stably fed one by one from the first storage portion 202.

Conventionally, there is a problem that abrasion on the surface of the retard roller 33 is increased due to the sliding contact between the sheet P and the retard roller 33. However, according to the present embodiment, the retard roller 33 is separated from the circumferential surface of the sheet feed roller 32 after the leading end of the first sheet P1 passes through the sheet feed nip portion N as described above. This structure prevents the abrasion on the outer circumferential portion of the retard roller 33 caused by the strong sliding contact between the first sheet P1 and the retard roller 33. Since the restriction member 50 presses the second sheet P2 from thereabove even if the retard roller 33 is separated from the circumferential surface of the sheet feed roller 32, the feeding of the second sheet P2 to the sheet feed nip portion N from the first storage portion 202 is prevented. Alternatively, even if the leading end of the second sheet P2 enters the sheet feed nip portion N, further conveyance of the leading end toward the downstream side in the conveying direction is prevented. As a result, the sheet P is stably conveyed in the first sheet conveying path 205, and the abrasion of the retard roller 33 is appropriately prevented. Even if the outer circumferential portion, of the retard roller 33, opposing the circumferential surface is made of an elastic material that is liable to be abraded, this abrasion is appropriately prevented.

As described above, the sheet P is stored in the first storage portion 202 so as to be oriented along substantially the horizontal direction, and the restriction member 50 contacts with the sheet surface from above the sheet P stored in the first storage portion 202, whereby the feeding of the sheet P can be restricted by a simple upward-downward movement of the restriction member 50.

In the image forming apparatus 1 provided with the above sheet feed deck 2, the sheets P are stably conveyed one by one into the first sheet conveying path 205 and the body-side conveying path 10P, and the abrasion of the retard roller 33 is appropriately prevented. In addition, an image is stably formed on the sheet P.

The sheet feed deck 2 and the image forming apparatus 1 provided with the sheet feed deck 2 according to the embodiment of the present disclosure are described above. However, the present disclosure is not limited thereto. For example, modifications described below may be implemented.

In the above embodiment, the retard roller 33 is used as the opposing member arranged opposing the circumferential surface of the sheet feed roller 32. However, the present disclosure is not limited thereto. A plate-like sheet feed pad arranged opposing the circumferential surface of the sheet feed roller 32 may be employed as the opposing member. Even in this case, the abrasion of the sheet feed pad is appropriately prevented. Even when the sheet feed pad is made of an elastic material, the abrasion is stably prevented.

In the above embodiment, the retard roller 33 rotates so as to follow the sheet feed roller 32. However, the present disclosure is not limited thereto. The retard roller 33 may be reversely rotated when the sheet feeding operation ends. In this case, the retard roller 33 is rotated in the direction opposite to the rotating direction of the sheet feed roller 32 at the sheet feed nip portion N.

In the above embodiment, the pickup roller 31 and the sheet feed roller 32 are synchronously driven. However, the present disclosure is not limited thereto. The pickup roller 31 may be rotated earlier than the sheet feed roller 32 when the sheet feeding operation is started. The rotation of the pickup roller 31 may be stopped earlier than the rotation of the sheet feed roller 32 when the sheet feeding operation ends. Even in this case, the drive control portion 61 rotationally drives the sheet feed roller 32 before the leading end of the first sheet P1 fed by the pickup roller 31 arrives at the sheet feed nip portion N, whereby the first sheet P1 stably passes through the sheet feed nip portion N. As described above, also when the pickup roller 31 and the sheet feed roller 32 are rotationally driven in synchronism with each other, the drive control portion 61 rotationally drives the sheet feed roller 32 before the leading end of the first sheet P1 arrives at the sheet feed nip portion N.

In the above embodiment, after the leading end of the first sheet P1 is detected by the sheet sensor 73, the retard roller 33 is separated from the circumferential surface of the sheet feed roller 32, and the restriction member 50 is brought into contact with the sheet surface of the second sheet P2. However, the present disclosure is not limited thereto. Specifically, after the first sheet P1 is fed by the pickup roller 31 and the leading end of the first sheet P1 passes through the sheet feed nip portion N, the drive control portion 61 may cause the retard roller 33 to separate from the circumferential surface of the sheet feed roller 32 and cause the restriction member 50 to contact with the second sheet P2. Also in this structure, the sheet feeding operation for the second sheet P2 by the pickup roller 31 is stably started.

In the above embodiment, after the rear end of the first sheet P1 is detected by the sheet sensor 73, the drive control portion 61 causes the retard roller 33 to contact with the circumferential surface of the sheet feed roller 32 and causes the restriction member 50 to separate from the second sheet P2. However, the present disclosure is not limited thereto. Specifically, the drive control portion 61 may cause the retard roller 33 to contact with the circumferential surface of the sheet feed roller 32 and cause the restriction member 50 to separate from the second sheet P2, after the rear end of the first sheet P1 passes through the sheet feed nip portion N and before the second sheet P2 is fed by the pickup roller 31.

The above restriction member 50 may be arranged in not only the first storage portion 202 but also the second storage portion 203.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying apparatus comprising:

a housing:

a sheet storage portion, arranged in the housing, configured to store a sheet stack of sheets;

a sheet conveying path which extends from the sheet storage portion and in which the sheets are conveyed;

a pickup roller configured to contact with a sheet surface of an uppermost sheet in the sheet stack stored in the sheet storage portion, and to feed the sheet in a conveying direction for the sheets;

a sheet feed roller arranged downstream of the pickup roller in the conveying direction, and configured to convey the sheet in the conveying direction by contacting with the sheet;

an opposing member arranged opposing the sheet feed roller and forming, in conjunction with the sheet feed roller, a sheet feed nip portion through which the sheet passes;

a roller drive portion configured to rotationally drive the pickup roller and the sheet feed roller;

a first drive portion configured to cause the opposing member to contact with or separate from the sheet feed roller;

a restriction member configured to contact with a rear end of a sheet surface, in the conveying direction, of the uppermost sheet in the sheet stack stored in the sheet storage portion, and to restrict feeding of the sheet from the sheet storage portion;

a second drive portion configured to cause the restriction member to contact with or separate from the sheet surface;

a drive control portion configured to control the roller drive portion, the first drive portion, and the second drive portion;

a pair of conveying rollers arranged downstream of the sheet feed roller in the conveying direction in the sheet conveying path, the pair of conveying rollers configured to form a conveying nip portion through which the sheet is conveyed in the conveying direction;

a sheet detection portion, arranged between the sheet feed roller and the pair of conveying rollers, configured to detect the sheet conveyed in the sheet conveying path; and a counting portion configured to calculate a timing when the leading end of a first sheet arrives at the conveying nip portion based on detection information indicating that the sheet detection portion detects the leading end of the first sheet, wherein the drive control portion causes the opposing member and the restriction member to be in a contact state or a separated state based on a calculation result by the counting portion, the drive control portion causes the opposing member to separate from the sheet feed roller, and causes the restriction member to contact with a sheet surface of a second sheet located below the first sheet that is located on an uppermost position of the sheet stack, after the first sheet is fed by the pickup roller and a leading end of the first sheet in the conveying direction passes through the sheet feed nip portion and arrives at the conveying nip portion, and the drive control portion causes the opposing member to contact with the sheet feed roller and causes the restriction member to separate from the second sheet, after the rear end of the first sheet is detected by the sheet detection portion and before the second sheet is fed by the pickup roller.

2. The sheet conveying apparatus according to claim 1, wherein the restriction member is brought into contact with the sheet surface of the second sheet with biasing force.

3. The sheet conveying apparatus according to claim 2, wherein the restriction member is brought into contact with the sheet surface of the second sheet with its own weight.

4. The sheet conveying apparatus according to claim 1, wherein the drive control portion rotationally drives the sheet feed roller before the leading end of the first sheet arrives at the sheet feed nip portion, and stops the rotation of the sheet feed roller after the leading end of the first sheet arrives at the conveying nip portion.

5. The sheet conveying apparatus according to claim 1, wherein the drive control portion causes the opposing member to contact with the sheet feed roller and causes the restriction member to separate from the second sheet, after the rear end of the first sheet in the conveying direction passes through the sheet feed nip portion and before the second sheet is fed by the pickup roller.

6. The sheet conveying apparatus according to claim 1, wherein the opposing member is a sheet feed pad or a retard roller arranged opposing the sheet feed roller.

7. The sheet conveying apparatus according to claim 6, wherein a contact portion, which is brought into contact with the sheet surface, of the restriction member is made of an elastic material.

8. The sheet conveying apparatus according to claim 1, wherein the sheet is stored in the sheet storage portion so as to be oriented along substantially the horizontal direction, and the restriction member contacts with the sheet surface from above the sheet stored in the sheet storage portion.

9. An image forming apparatus comprising:

a sheet conveying apparatus configured to convey a sheet;

an image forming portion configured to form an image onto the sheet conveyed by the sheet conveying apparatus; and a drive control portion, wherein the sheet conveying apparatus includes:

a housing:

a sheet storage portion, arranged in the housing, configured to store a sheet stack of sheets;

a sheet conveying path which extends from the sheet storage portion and in which the sheets are conveyed;

a pickup roller configured to contact with a sheet surface of an uppermost sheet in the sheet stack stored in the sheet storage portion, and to feed the sheet in a conveying direction for the sheets;

a sheet feed roller arranged downstream of the pickup roller in the conveying direction, and configured to convey the sheet in the conveying direction by contacting with the sheet;

an opposing member arranged opposing the sheet feed roller and forming, in conjunction with the sheet feed roller, a sheet feed nip portion through which the sheet passes;

a roller drive portion configured to rotationally drive the pickup roller and the sheet feed roller;

a first drive portion configured to cause the opposing member to contact with or separate from the sheet feed roller;

a restriction member configured to contact with a rear end of a sheet surface, in the conveying direction, of the uppermost sheet in the sheet stack stored in the sheet storage portion, and to restrict feeding of the sheet from the sheet storage portion;

a pair of conveying rollers arranged downstream of the sheet feed roller in the conveying direction in the sheet conveying path, the pair of conveying rollers configured to form a conveying nip portion through which the sheet is conveyed in the conveying direction;

a sheet detection portion, arranged between the sheet feed roller and the pair of conveying rollers, configured to detect the sheet conveyed in the sheet conveying path;

a counting portion configured to calculate a timing when the leading end of a first sheet arrives at the conveying nip portion based on detection information indicating that the sheet detection portion detects the leading end of the first sheet; and a second drive portion configured to cause the restriction member to contact with or separate from the sheet surface, wherein the drive control portion causes the opposing member and the restriction member to be in a contact state or a separated state based on a calculation result by the counting portion, the drive control portion causes the opposing member to separate from the sheet feed roller, and causes the restriction member to contact with a sheet surface of a second sheet located below the first sheet that is located on an uppermost position of the sheet stack, after the first sheet is fed by the pickup roller and a leading end of the first sheet in the conveying direction passes through the sheet feed nip portion and arrives at the conveying nip portion, and the drive control portion causes the opposing member to contact with the sheet feed roller and causes the restriction member to separate from the second sheet, after the rear end of the first sheet is detected by the sheet detection portion and before the second sheet is fed by the pickup roller.

10. The image forming apparatus according to claim 9, wherein the drive control portion rotationally drives the sheet feed roller before the leading end of the first sheet arrives at the sheet feed nip portion, and stops the rotation of the sheet feed roller after the leading end of the first sheet arrives at the conveying nip portion.

11. The image forming apparatus according to claim 9, wherein the drive control portion causes the opposing member to contact with the sheet feed roller and causes the restriction member to separate from the second sheet, after the rear end of the first sheet in the conveying direction passes through the sheet feed nip portion and before the second sheet is fed by the pickup roller.

* * * * *